US008960830B2

(12) United States Patent
Miura

(10) Patent No.: US 8,960,830 B2
(45) Date of Patent: Feb. 24, 2015

(54) INKJET PRINTING APPARATUS AND INKJET PRINTING METHOD

(71) Applicant: Canon Finetech Inc., Saitama (JP)

(72) Inventor: Takeshi Miura, Yokohama (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 13/771,367

(22) Filed: Feb. 20, 2013

(65) Prior Publication Data

US 2013/0222447 A1 Aug. 29, 2013

(30) Foreign Application Priority Data

Feb. 24, 2012 (JP) ..... 2012-038499
Nov. 22, 2012 (JP) ..... 2012-256489

(51) Int. Cl.

| | |
|---|---|
| ***B41J 25/308*** | (2006.01) |
| ***B41J 11/00*** | (2006.01) |
| *B41J 11/20* | (2006.01) |
| *B41J 19/30* | (2006.01) |
| *B41J 19/18* | (2006.01) |

(52) U.S. Cl.

CPC ..... *B41J 11/008* (2013.01); *B41J 25/308* (2013.01)

USPC ..... 347/8; 400/55; 400/56; 400/57; 400/58; 400/59; 400/60

(58) Field of Classification Search

CPC ... B41J 25/308; B41J 25/3082; B41J 25/3088

USPC ..... 347/8; 400/55–60, 323

See application file for complete search history.

(56) References Cited

U.S. PATENT DOCUMENTS

| | | | | |
|---|---|---|---|---|
| 6,554,416 | B2 * | 4/2003 | Koto | 347/104 |
| 6,945,628 | B2 * | 9/2005 | Koitabashi et al. | 347/34 |
| 7,044,575 | B2 * | 5/2006 | Kelley et al. | 347/19 |
| 7,735,946 | B2 * | 6/2010 | Tanaka et al. | 347/8 |
| 8,628,181 | B2 * | 1/2014 | Usuda et al. | 347/95 |

(Continued)

FOREIGN PATENT DOCUMENTS

| | | | |
|---|---|---|---|
| JP | 6-247002 | A | 9/1994 |
| JP | 2002-154200 | A | 5/2002 |

(Continued)

OTHER PUBLICATIONS

Office Action in Japanese Application No. 2012-256489, dated Jun. 17, 2014.

*Primary Examiner* — Laura Martin
*Assistant Examiner* — Jeremy Bishop
(74) *Attorney, Agent, or Firm* — Fitzpatrick, Cella, Harper & Scinto

(57) ABSTRACT

An inkjet printing head prints an image on a printing medium located at a printing position facing the printing head, by a printing operation in which the printing head ejects ink onto the printing medium, and the printing head is capable of resuming the printing operation after suspension of the printing operation. A supporting unit supports the printing medium on which the image is printed by the printing head, and an adjusting unit is capable of adjusting a facing distance between the printing head and the supporting unit. A control unit controls the adjusting unit so that the facing distance is greater than that during the printing of a printed image, in case the printing operation is resumed and the printed image moves relative to the printing position. The control unit controls the adjusting unit based on the time elapsed between the suspension of the printing operation and the resumption of the printing operation, so that the facing distance is greater as the elapsed time is longer.

8 Claims, 18 Drawing Sheets

(56) References Cited

U.S. PATENT DOCUMENTS 8,696,082 B2 * 4/2014 Loper et al. ..... 347/16

FOREIGN PATENT DOCUMENTS

JP 2004-351816 A 12/2004
JP 2005-081717 A 3/2005
JP 2006-150798 A 6/2006
JP 2006-224541 A 8/2006
JP 2007-152783 A 6/2007
JP 2008-065622 A 3/2008
JP 2009-119713 A 6/2009
JP 2010-047014 A 3/2010
JP 2011-126082 A 6/2011

* cited by examiner

| | AMOUNT OF INCREASE IN DISTANCE TO PAPER ACCORDING TO ELAPSED TIME[mm] | | |
|---|---|---|---|
| PRINTING DUTY[%] | 10 s OR LESS | 10 s TO 20 s | 20 s OR MORE |
| 0 ~ 60 | 0 | 0 | 0 |
| 60 ~ 80 | 0 | 0 | 0.3 |
| 80 ~ 100 | 0.3 | 0.3 | 0.7 |
| 100 ~ 120 | 0.3 | 0.5 | 0.7 |
| 120 ~ 140 | 0.3 | 0.6 | 0.9 |
| 140 ~ 160 | 0.4 | 0.7 | 1.3 |
| 160 ~ 180 | 0.5 | 0.9 | 1.4 |
| 180 ~ | 0.5 | 1.0 | 1.6 |

FIG.15

INKJET PRINTING APPARATUS AND INKJET PRINTING METHOD

BACKGROUND OF THE INVENTION

1. Field of the Invention

The present invention relates to an inkjet printing apparatus and an inkjet printing method capable of resuming image printing operation so as to print an image continuous with a printed image after suspension of the printing operation.

2. Description of the Related Art

What are called serial scan type and full line type printing apparatuses are known as an inkjet printing apparatus in which a printing head capable of ejecting ink is used for image printing. The serial scan type is configured for image printing which involves movement of the printing head in a main scan direction and conveyance of a printing medium in a sub-scan direction intersecting the main scan direction, while the full line type is configured for image printing which involves the conveyance of the printing medium without involving the movement of the printing head.

Ink droplets ejected from the printing head include large major droplets, and satellites as tiny droplets. The major droplets are ejected at a predetermined rate, whereas the satellites ejected following after the major droplets are prone to be low in their rate of ejection and also unstable in their direction of ejection. Desirably, a facing distance between the printing head and the printing medium (hereinafter, sometimes called a "head-medium distance") is reduced in order to reduce displacements of the landing positions of the ink droplets on the printing medium. The satellites, in particular, are susceptible to air resistance or flows of air, and therefore, a reduction in the head-medium distance is effective for a reduction in displacements of the landing positions of the satellites.

Setting the head-medium distance as described above requires taking into account the thickness of the printing medium, the floating of the printing medium above a printing medium conveyor line, and the expansion and contraction (hereinafter, sometimes called "cockling") of the printing medium when it absorbs the ink.

The thickness of the printing medium can be determined beforehand prior to the printing operation, depending on the type of the printing medium. However, the cockling or the floating of the printing medium is difficult to determine before the printing operation, because the cockling or the floating depends on image conditions or environmental conditions during image printing. The cockling, in particular, is a phenomenon in which its size, range, or the like grows. Factors responsible for the growth of the cockling include the amount of ink ejected (or the amount of ink applied) to the printing medium, and the elapsed time since the time of image printing. A larger amount of ink ejected leads to a larger amount of ink absorbed into the printing medium and hence to a larger amount of expansion and contraction of the printing medium. In addition, a longer elapsed time since the time of image printing leads to an increasingly larger amount of ink absorbed into the printing medium, after which the ink is dried, and in turn, to a larger amount of expansion and contraction of the printing medium. It is difficult to maintain a certain head-medium distance, taking into account such a change in the cockling.

On the other hand, too short the head-medium distance may lead to contact of the printing head with the printing medium. Such contact may occur during reciprocating movements of the printing head in the main scan direction, for example in the serial scan type printing apparatus, particularly a consumer-oriented printing apparatus in which the printing medium is conveyed at a low rate of conveyance. In the full line type printing apparatus, the printing medium is continuously conveyed during printing operation, and thus, the printing medium which has cockled moves immediately past a printing position facing the printing head, which in turn reduces the likelihood of occurrence of the contact of the printing head with the printing medium. However, situations may arise where continuous printing operation involving the continuous conveyance of the printing medium is suspended for some cause and the printing of an image still in process of being printed is suspended and, thereafter, maintenance operation for the printing head or the like is performed and then the printing operation is resumed from a point in the image at which the printing has been suspended. In such situations, there is a possibility that the printing head contacts with the printing medium which has cockled before the suspension of the printing operation.

Japanese Patent Laid-Open No. 2009-119713 discloses a method which involves detecting the height of a printing medium varying by cockling, from a printed result of a cockling detection pattern, and setting the position of a printing head in its height direction under normal printing operation conditions, based on the detected height.

The method disclosed in Japanese Patent Laid-Open No. 2009-119713 can grasp beforehand the extent of cockling which may occur, based on the printed result of the cockling detection pattern. However, as described above, when printing operation for an image is suspended and thereafter the printing is resumed from a point in the image, a change in the cockling during the suspension of the printing operation cannot be grasped. At the time of such resumption of the printing, it is therefore necessary that the head-medium distance is set larger than an assumed value to avoid the contact of the printing head with the printing medium before it happens.

SUMMARY OF THE INVENTION

The present invention provides an inkjet printing apparatus and an inkjet printing method capable of avoiding contact of a printing head with a printed image on a printing medium, at the time of resumption of printing operation which has been suspended.

In the first aspect of the present invention, there is provided an inkjet printing apparatus for printing an image on a printing medium by a printing operation in which a printing head ejects ink onto the printing medium located at a printing position facing the printing head, the apparatus being capable of resuming the printing operation after suspension of the printing operation, the apparatus comprising: a supporting unit configured to support the printing medium on which the image is printed by the printing head; an adjusting unit capable of adjusting a facing distance between the printing head and the supporting unit; and a control unit configured to control the adjusting unit so that the facing distance is greater than that during the printing of a printed image, in case the printing operation is resumed and the printed image moves relative to the printing position, wherein the control unit controls the adjusting unit based on a time elapsed between the suspension of the printing operation and the resumption of the printing operation, so that the facing distance is greater as the elapsed time is longer.

In the second aspect of the present invention, there is provided an inkjet printing method for printing an image on a printing medium by a printing operation in which a printing head ejects ink onto the printing medium located at a printing position facing the printing head, in which the printing operation is resumed after suspension of the printing operation, the method comprising the step of: in case the printing operation is resumed and the printed image moves relative to the printing position, setting a facing distance between the printing head and a supporting unit supporting the printing medium on which the image is printed by the printing head, greater than that during the printing of a printed image, wherein the facing distance is set greater as a time elapsed between the suspension of the printing operation and the resumption of the printing operation is longer.

In the third aspect of the present invention, there is provided an inkjet printing apparatus for printing an image on a printing medium by a printing operation in which a printing head ejects ink onto the printing medium located at a printing position facing the printing head, the apparatus being capable of resuming the printing operation after suspension of the printing operation, the apparatus comprising: a supporting unit configured to support the printing medium on which the image is printed by the printing head; an adjusting unit capable of adjusting a facing distance between the printing head and the supporting unit; and a control unit configured to control the adjusting unit so that the facing distance is greater than that during the printing of a printed image, in case the printing operation is resumed and the printed image moves relative to the printing position, wherein the control unit controls the adjusting unit based on information corresponding to the amount of ink applied during the printing of the printed image moving relative to the printing position, so that the facing distance is greater as the amount of ink applied is larger.

In the fourth aspect of the present invention, there is provided an inkjet printing method for printing an image on a printing medium by a printing operation in which a printing head ejects ink onto the printing medium located at a printing position facing the printing head, in which the printing operation is resumed after suspension of the printing operation, the method comprising the step of: in case the printing operation is resumed and the printed image moves relative to the printing position, setting a facing distance between the printing head and a supporting unit supporting the printing medium on which the image is printed by the printing head, greater than that during the printing of a printed image, wherein the facing distance is set greater as the amount of ink applied during the printing of the printed image moving relative to the printing position is larger.

According to the present invention, at the time of resumption of printing operation which has been suspended, in case the printed image on the printing medium moves relative to the printing position facing the printing head, the facing distance between the printing head and the supporting unit supporting the printing medium is increased. Thereby, the contact of the printing medium with the printing head can be avoided.

Further features of the present invention will become apparent from the following description of exemplary embodiments (with reference to the attached drawings).

BRIEF DESCRIPTION OF THE DRAWINGS

FIG. 15 is a table for explaining a control table in which the elapsed time since the suspension of the printing operation, the printing duty, and the head-medium distance are associated with one another;

DESCRIPTION OF THE EMBODIMENTS

Embodiments of the present invention will be described below with reference to the drawings.

First Embodiment

Figure 1:
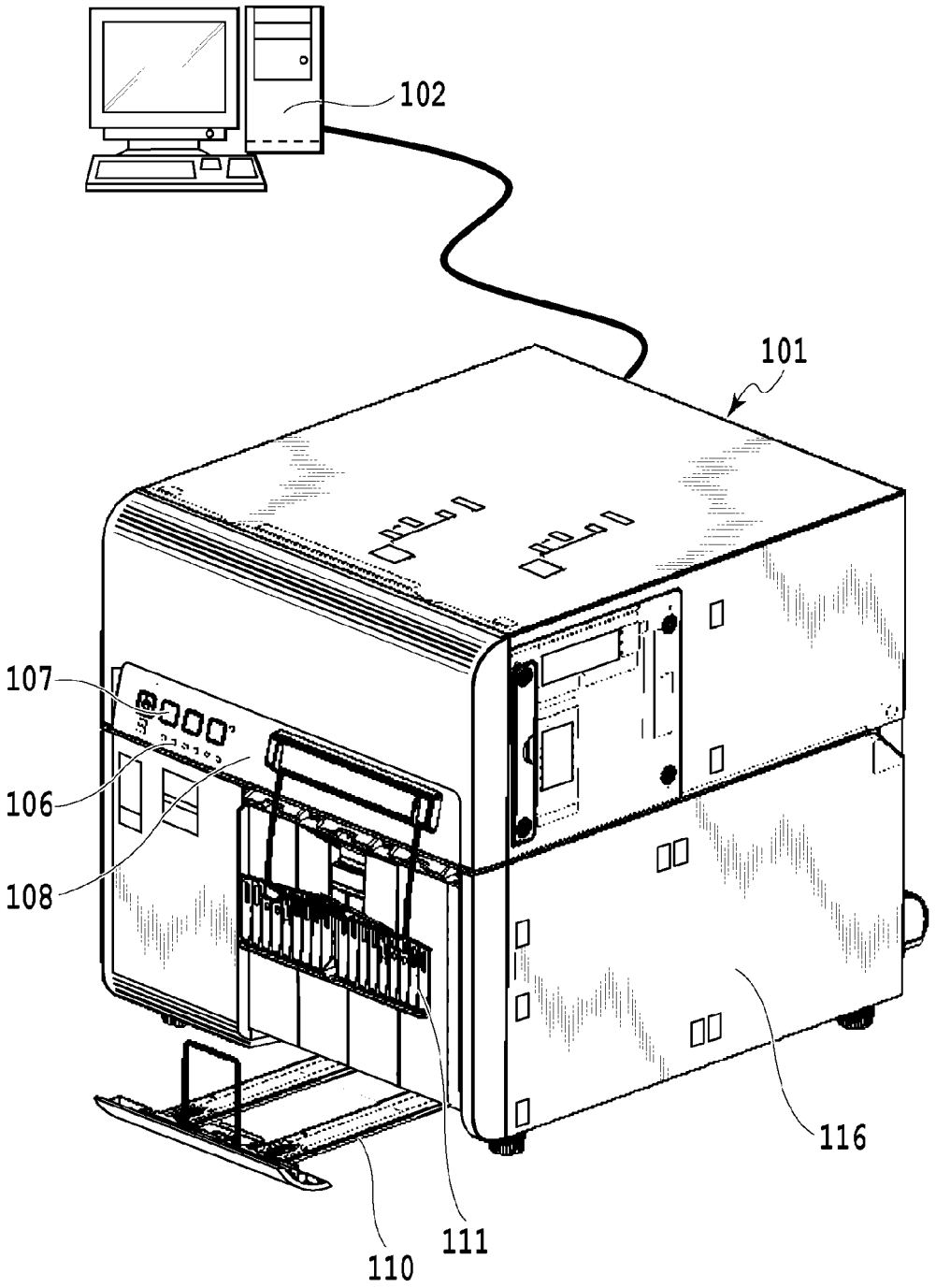
FIG. 1 is a schematic perspective view of an inkjet printing apparatus of a first embodiment of the present invention.

FIG. 1 is a schematic perspective view of an inkjet printing apparatus 101 of a first embodiment.

The inkjet printing apparatus 101 of the first embodiment is connected to a host PC 102 (or a personal computer) to transmit image information to the printing apparatus 101. The printing apparatus 101 includes a printing head 103 (see FIG. 5) to print an image by ejecting ink onto fanfold paper (or continuous forms paper) P as a printing medium, and a recovery unit 104 (see FIG. 5) to maintain printing performance of the printing head 103. The printing head 103 and the recovery unit 104 form a printing engine 105 (see FIG. 5). As described later, the printing engine 105 has two printing head modules 112 (112*a*, 112*b*) built-in, each including plural printing heads 103. In addition, the printing apparatus 101 includes a console panel 108 including a display panel 106 and a button 107, and a paper discharging guide 111 to guide the paper P discharged from a conveyor unit 109 (see FIG. 2) to a stacker unit 110. Moreover, the printing apparatus 101 includes a paper feed unit 113 (see FIG. 5) to set the paper P therein, the conveyor unit 109 to convey the paper P, and the stacker unit 110 to store the discharged paper P. Further, the printing apparatus 101 includes an ink supply unit 114 (see FIG. 2) to supply the ink to the printing head 103, and a maintenance reservoir unit 115 (see FIG. 5) to store the ink produced during cleaning of the printing head. The conveyor unit 109 and the ink supply unit 114 are built into a base unit 116.

Figure 2:
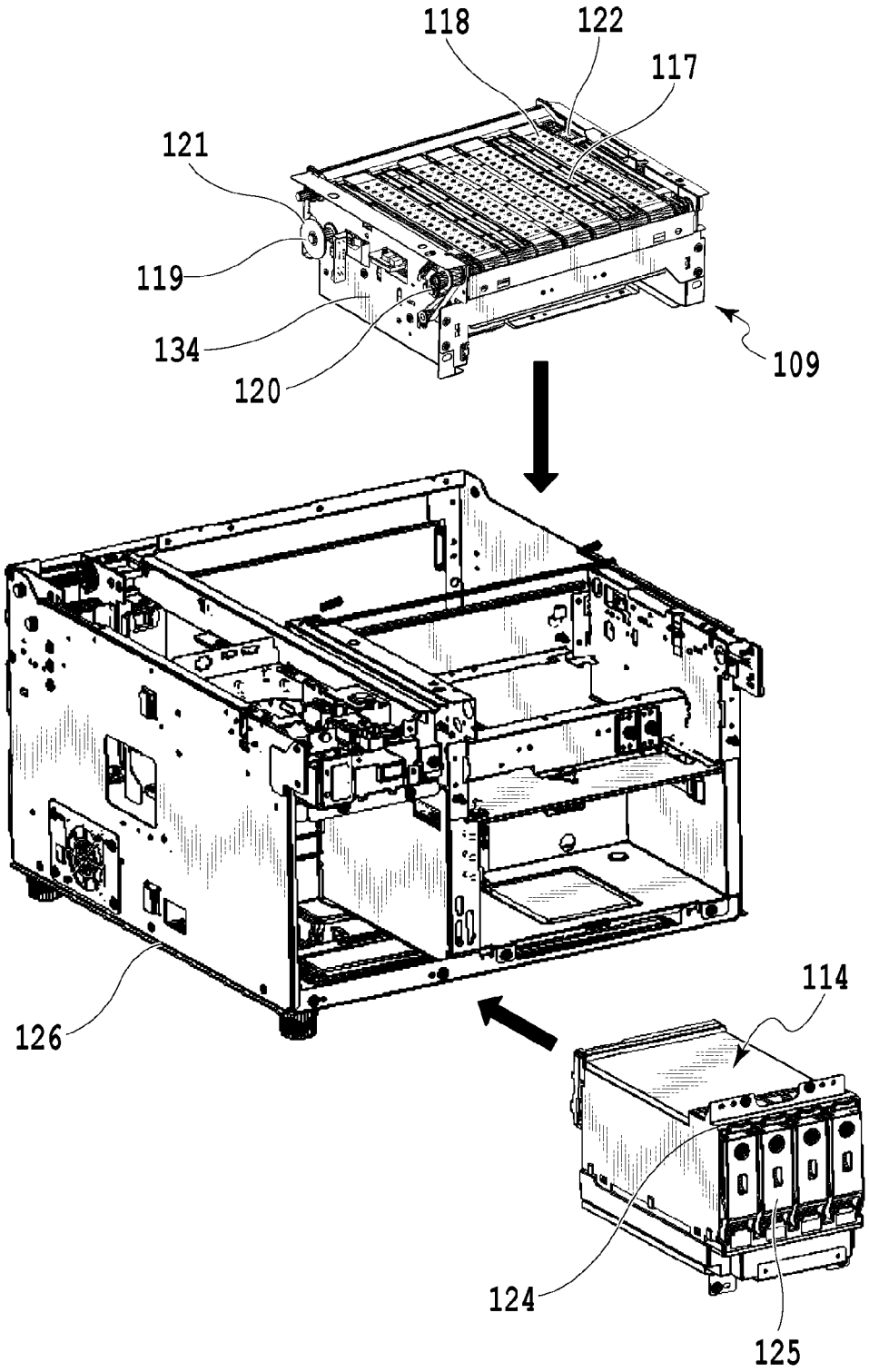
FIG. 2 is an exploded perspective view of assistance in explaining an internal structure of the printing apparatus of FIG. 1.

FIG. 2 is an exploded perspective view of assistance in explaining an internal structure of the base unit 116.

The printing apparatus 101 of the first embodiment is modular in its principal part. For example, the conveyor unit 109 is constructed of a platen 117, a conveyor belt 118, a conveyor shaft 119, a conveyor motor 120, an encoder 121, and a conveyor frame 134, and the like. These structural components are assembled into the conveyor unit 109 as a module. The conveyor belt 118 is configured as a supporting unit to support the printing medium on which an image is printed by the printing head 103. The ink supply unit 114 is integrally formed with an ink tank holder 124 capable of accommodating ink tanks for black ink, cyan ink, magenta ink, and yellow ink. In addition, the ink supply unit 114 has built-in needles (un-illustrated) to engage the ink tanks in order to supply the ink in the ink tanks to the printing heads 103, and is further provided with lids 125 for holding the ink tanks. The modular units 109, 114 are assembled to a frame unit 126 to form the base unit 116.

Figure 3:
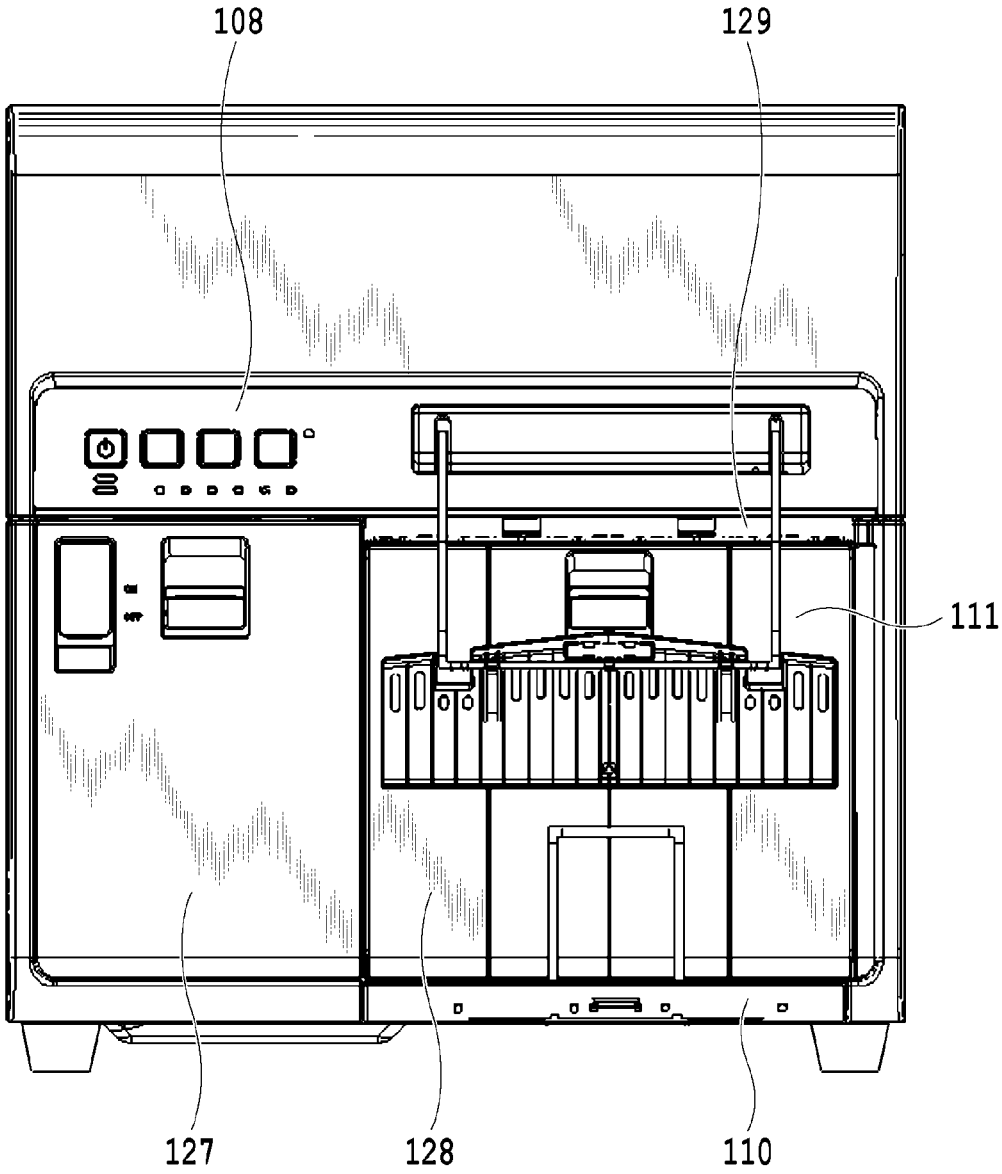
FIG. 3 is a front view of the printing apparatus of FIG. 1.

FIG. 3 is a front view of the printing apparatus 101.

A front face of the printing apparatus 101 of the first embodiment is provided with the console panel 108 for a user to do paper feed or other operations, an ink tank door 127 covering an attachment portion of the ink tanks, and a maintenance cartridge door 128. The maintenance cartridge door 128 is the door covering an attachment portion of a maintenance cartridge to store waste ink produced during a recovery process for the printing head 103. Further, the front face of the printing apparatus 101 is provided with a discharge port 129 into which the printed paper P is discharged, the paper discharging guide 111 to guide the paper P to the stacker unit 110, and the stacker unit 110 to stack the paper P.

Figure 4:
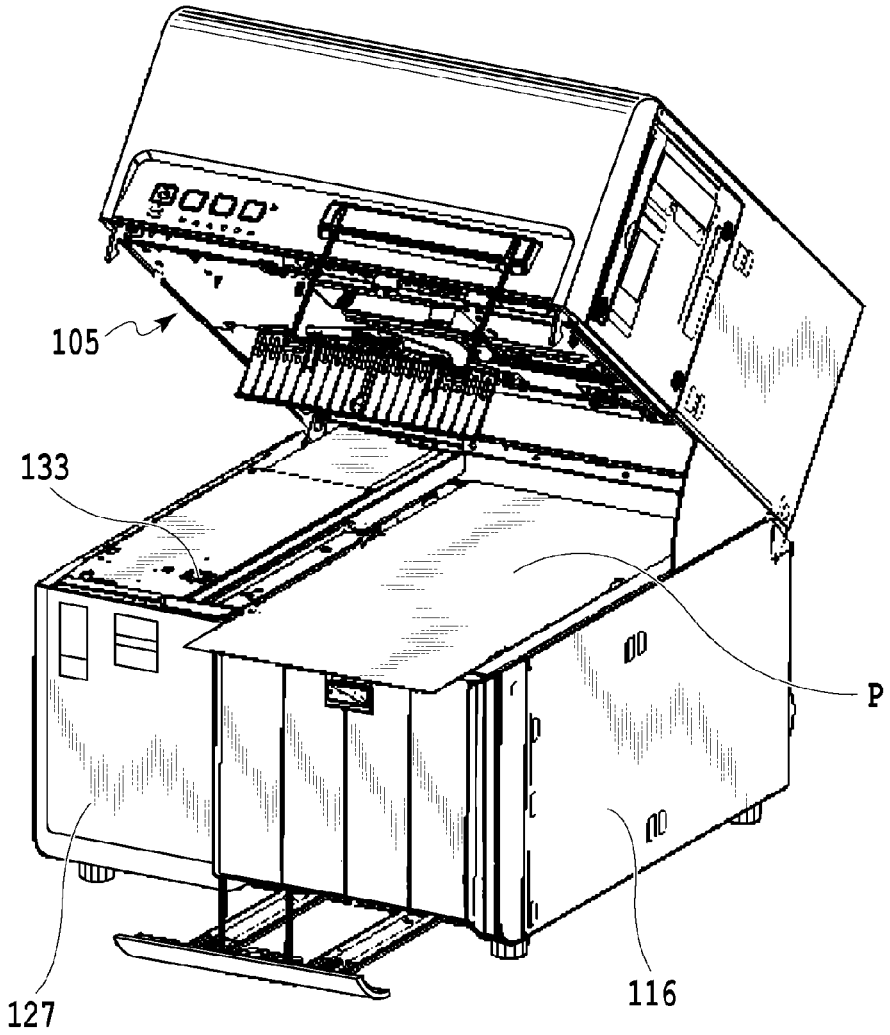
FIG. 4 is a perspective view of assistance in explaining how paper is set in the printing apparatus of FIG. 1.

FIG. 4 is a perspective view of assistance in explaining how the paper P is set in the printing apparatus 101.

When the paper P is to be set, the ink tank door 127 is opened and a printing unit lever (un-illustrated) located in an upper portion of the ink supply unit 114 is operated to rotate and open the printing engine 105. The paper feed unit 113 (see FIG. 5) located toward the rear of the base unit 116 moves up and down according to operation of an up-and-down button 133. When the paper P is to be set, the paper feed unit 113 is moved up and is drawn out frontward, and then the paper P is loaded in the paper feed unit 113. After the loading of the paper P, the paper feed unit 113 is moved backward and then down. An edge portion of the loaded paper P is pulled out toward the front face of the printing apparatus 101, as illustrated in FIG. 4.

Figure 5:
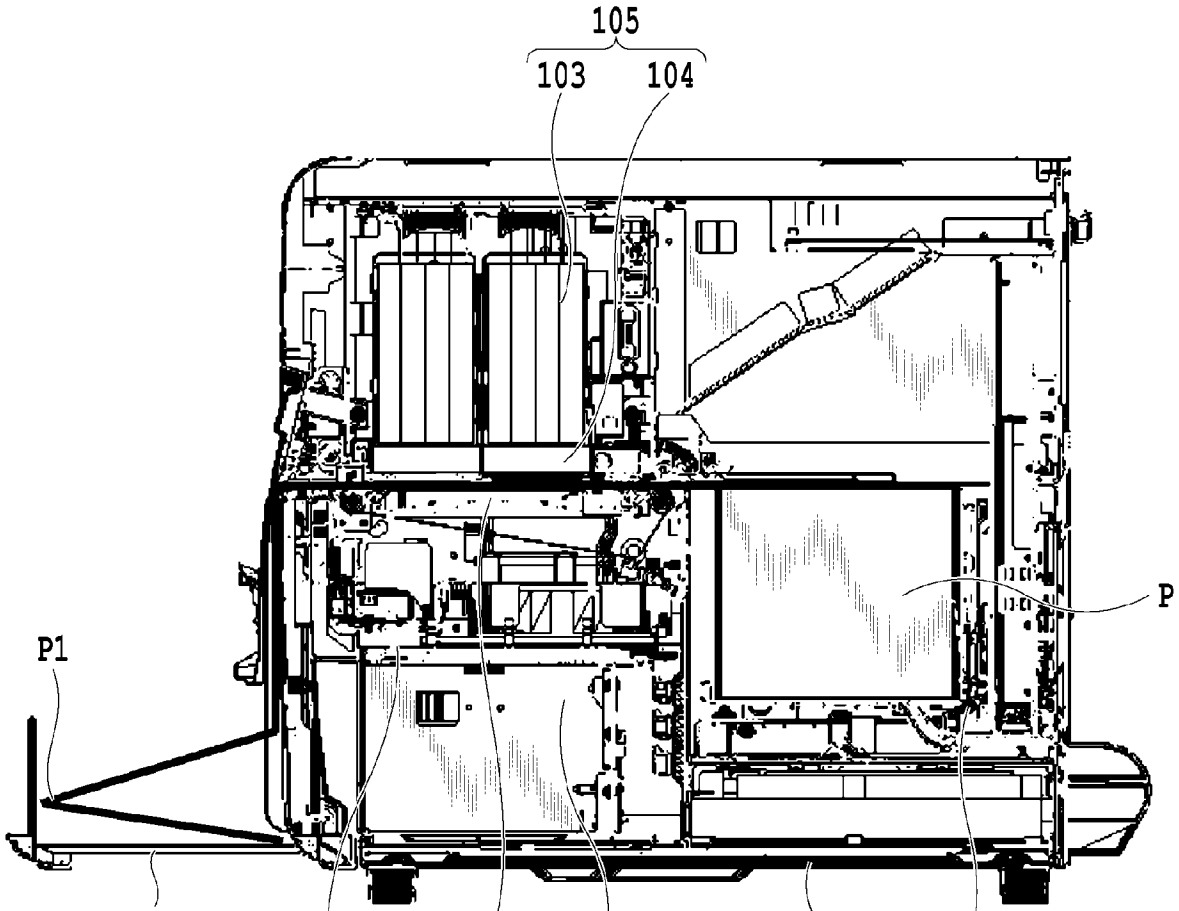
FIG. 5 is a sectional view of the printing apparatus of FIG. 1 as having the paper set therein.

FIG. 5 is a sectional view of the printing apparatus 101 as having the paper P set therein.

The paper P is set in the paper feed unit 113 located toward the rear of the base unit 116, and the edge portion of the paper P is passed between the printing head 103 and the conveyor unit 109 and is pulled out into the stacker unit 110. The edge portion of the paper P is folded in two or more along perforations P1 and placed in the stacker unit 110. At this time, a z-fold direction of the paper P is the same as a direction in which the paper P is folded in the paper feed unit 113. The conveyor belt 118 and the platen 117 of the conveyor unit 109 have holes formed therethrough, and the paper P is sucked through the holes by a suction force of a fan (un-illustrated) provided in a lower portion of the conveyor unit 109.

Figure 6:
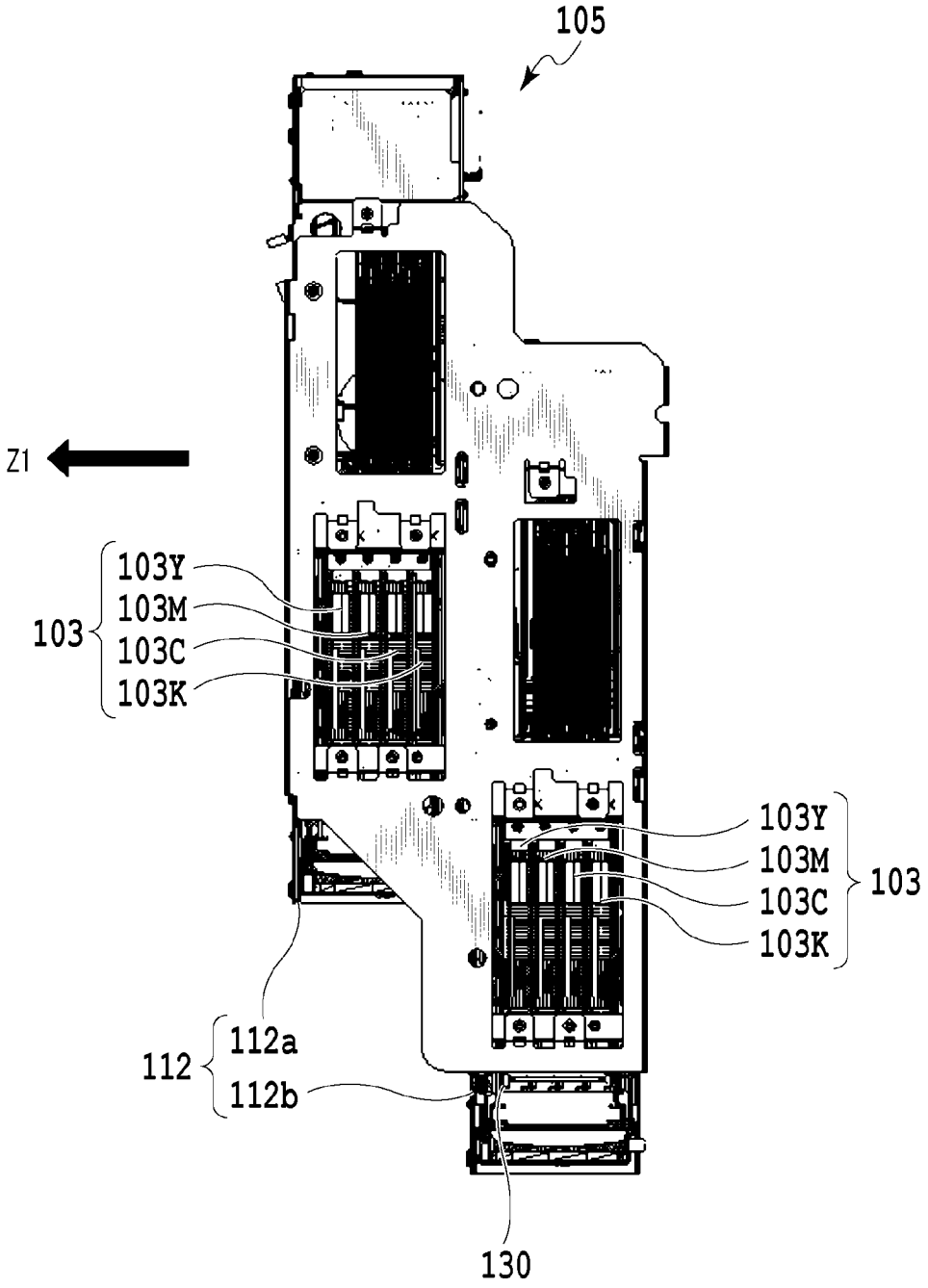
FIG. 6 is a plan view of a printing engine of the printing apparatus of FIG. 1.

FIG. 6 is a view of assistance in explaining the printing engine 105.

The printing engine 105 prints an image by ejecting the black ink, the cyan ink, the magenta ink and the yellow ink supplied from the ink supply unit 114. The printing engine 105 is configured so that the two printing head modules 112 (112*a*, 112*b*) are located in staggered fashion. The printing head modules 112 are each provided with four printing heads 103 (103K, 103C, 103M, 103Y) for ejecting the black, cyan, magenta and yellow ink, respectively. The two printing head modules 112 each includes a printing head raise/lower unit 130 for effecting up and down movement of the printing heads 103. During printing operation, the printing heads 103 are moved to a printing position closer to the surface of the paper P, while during maintenance operation under non-printing operation conditions, the printing heads 103 are moved to a maintenance position in contact with the recovery unit 104. As described later, a facing distance between the printing heads 103 and the conveyor belt 118 as the supporting unit can be adjusted according to such up and down movement of the printing head modules 112. The printing head raise/lower units 130 of the two printing head modules 112 are independently controlled and driven.

The printing heads 103 are each provided with plural nozzles in such a manner that an array of nozzles is formed along a direction intersecting (e.g., in this case, orthogonal to) a direction of conveyance of the paper P (e.g. a direction of arrow Z1). The nozzles eject the ink through ejection ports in the nozzle tips by using an ejection energy generating element such as an electrothermal conversion element (e.g. a heater) or a piezoelectric element. When the electrothermal conversion element is used, the ink is foamed by heat produced by the element, and this foaming energy can be used for ejection of the ink through the ejection ports in the nozzle tips.

Next, printing operation will be described.

The conveyor motor 120 and the printing engine 105 are driven based on a printing command signal transmitted from the PC 102. The paper P has stop marks 123 (see FIG. 7) for indicating the position of the paper P in the direction of conveyance. The stop marks 123 of the first embodiment are printed at a predetermined position determined with respect to the perforations P1 of the paper P. The conveyor unit 109 is provided with a mark sensor 122 (see FIG. 7), such as a reflection-type optical sensor, for detecting the stop mark 123. In the conveyor unit 109 (see FIG. 2), the conveyor motor 120 is controlled and driven according to a read signal from the encoder 121 provided on the conveyor shaft 119. The paper P is conveyed to the paper feed unit, the printing unit and the paper discharge port by the conveyor belt 118 driven by the conveyor motor 120. Before printing operation, the printing heads 103 are moved to the printing position by the printing head raise/lower units 130, and the printing heads 103 print an image by ejecting the ink onto the paper P in synchronization with the position of the paper P, detected based on a detection signal of the stop mark 123, and drive of the conveyor motor 120. Since the two printing head modules 112 (112*a*, 112*b*) are located in staggered fashion, a portion of connection (or a portion of joint) between images printed by the printing head modules is present in the vicinity of substantially the center of the paper P in its width direction. In the case of the first embodiment, as illustrated in FIG. 7, the ink is ejected from the printing heads 103 of the printing head module 112*b* close to the paper feed unit side, and then, the ink is ejected from the printing heads 103 of the printing head module 112*a* on the paper discharge side.

Next, description will be given with regard to a condition where, during printing operation for continuous image printing involving continuous conveyance of the paper P, the printing operation is suspended for maintenance of the printing head or the like and thereafter the image printing operation is resumed. The printing apparatus 101 is capable of resuming the printing operation so as to print an image continuous with a printed image which has been printed before the suspension of the printing operation.

When the maintenance of the printing heads 103 is necessary during image printing operation, conveying operation for the paper P is stopped in order to temporarily suspend the printing operation. A position at which the paper P is stopped is set with reference to the detected position of the stop mark 123 of the paper P. The start and stop of ink ejection by the printing heads are controlled based on the detection signal of the stop mark 123 from the mark sensor 122.

Figure 7:
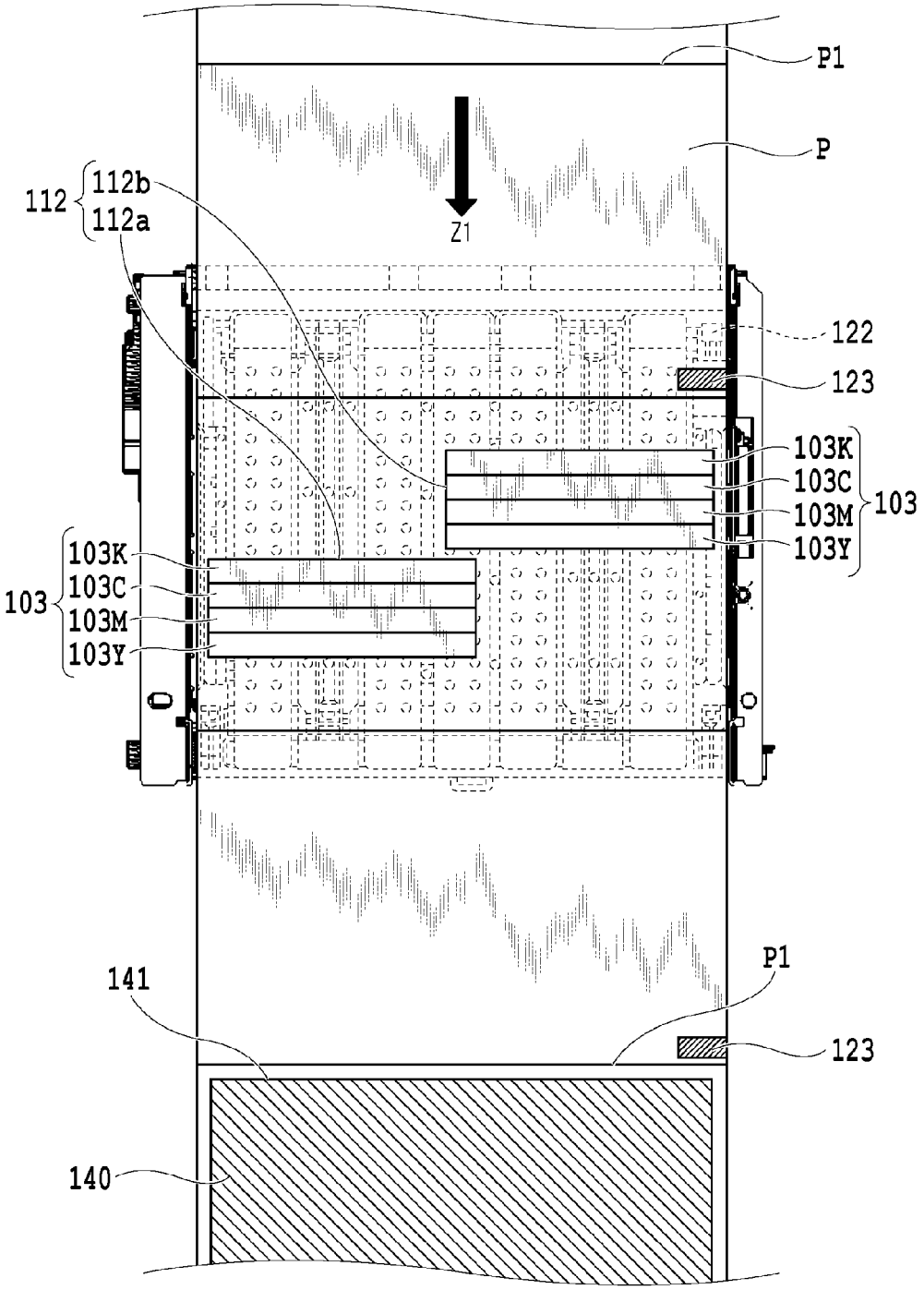
FIG. 7 is a view of assistance in explaining a condition where printing operation is suspended in the printing apparatus of FIG. 1.

FIG. 7 is a plan view of assistance in explaining a condition where image printing operation is suspended and the conveyance of the paper P is stopped. A position at which the conveyance of the paper P is stopped is the conveyance position at the time of detection of the next stop mark 123 by the mark sensor 122 after the suspension of the image printing operation, as illustrated in FIG. 7. After that, the printing heads 103 are moved to the maintenance position by the printing head raise/lower units 130, and maintenance operation is performed by the recovery unit 104. After the completion of the maintenance operation, the paper P is moved back in a direction of arrow Z2 opposite to the direction of conveyance.

Figure 8:
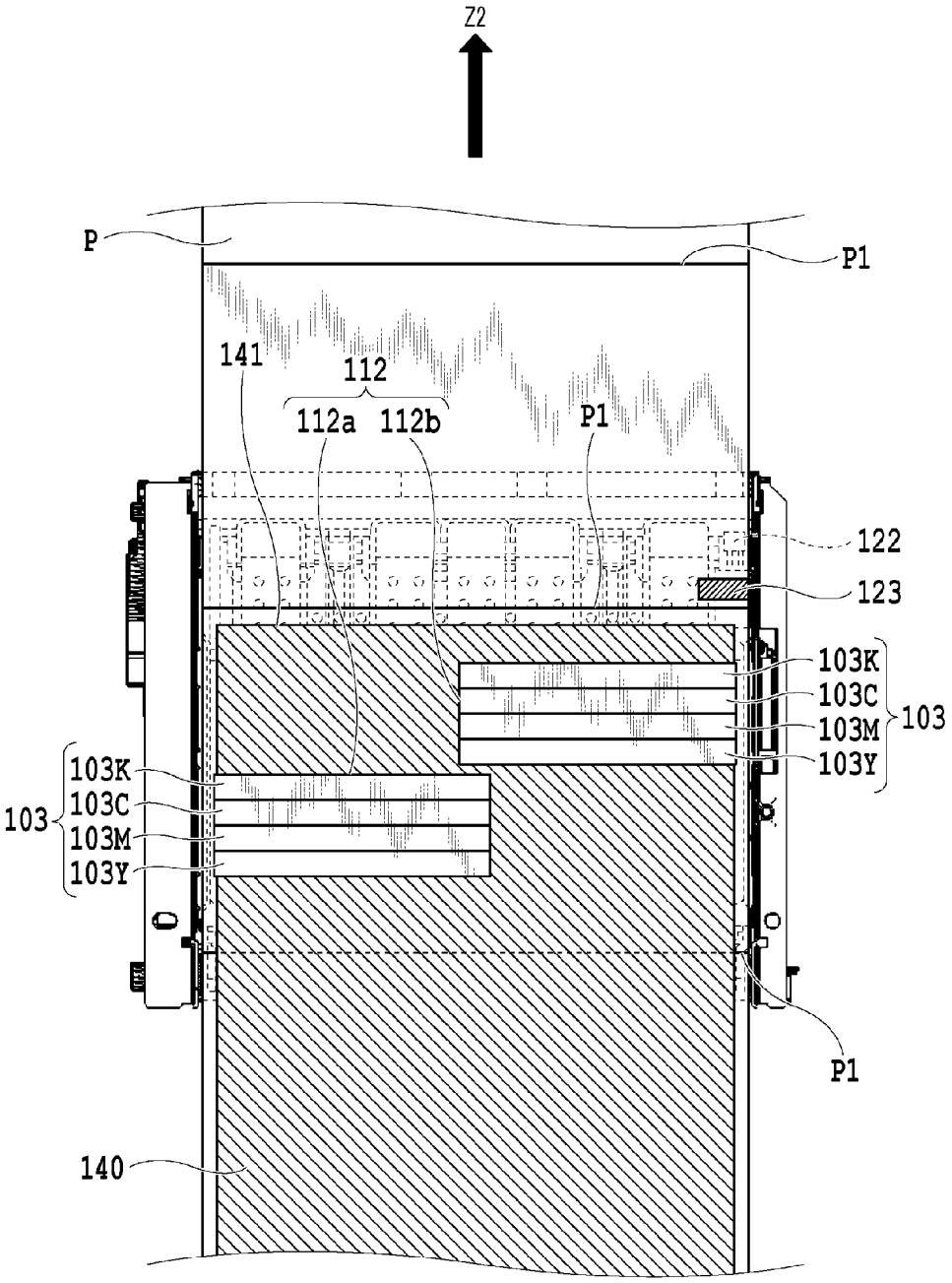
FIG. 8 is a view of assistance in explaining paper return operation of the printing apparatus of FIG. 1.

FIG. 8 is a view of assistance in explaining a condition where the paper P is moved back by a predetermined amount in the direction of arrow Z2 opposite to the direction of conveyance in order to resume image printing operation. The paper P is moved back in the direction of arrow Z2 until an image connection portion 141 is located in the direction of arrow Z2 with respect to the printing position of the printing heads. The image connection portion 141 is an end portion of a printed image which has been printed on the paper P until before the suspension of the printing operation, or equivalently, a portion of connection to an image to be printed by the resumption of the printing operation thereafter. As illustrated in FIG. 8, the paper P stops moving back in the direction of arrow Z2, when the mark sensor 122 detects the stop mark 123 in the vicinity of the image connection portion 141.

Figure 9:
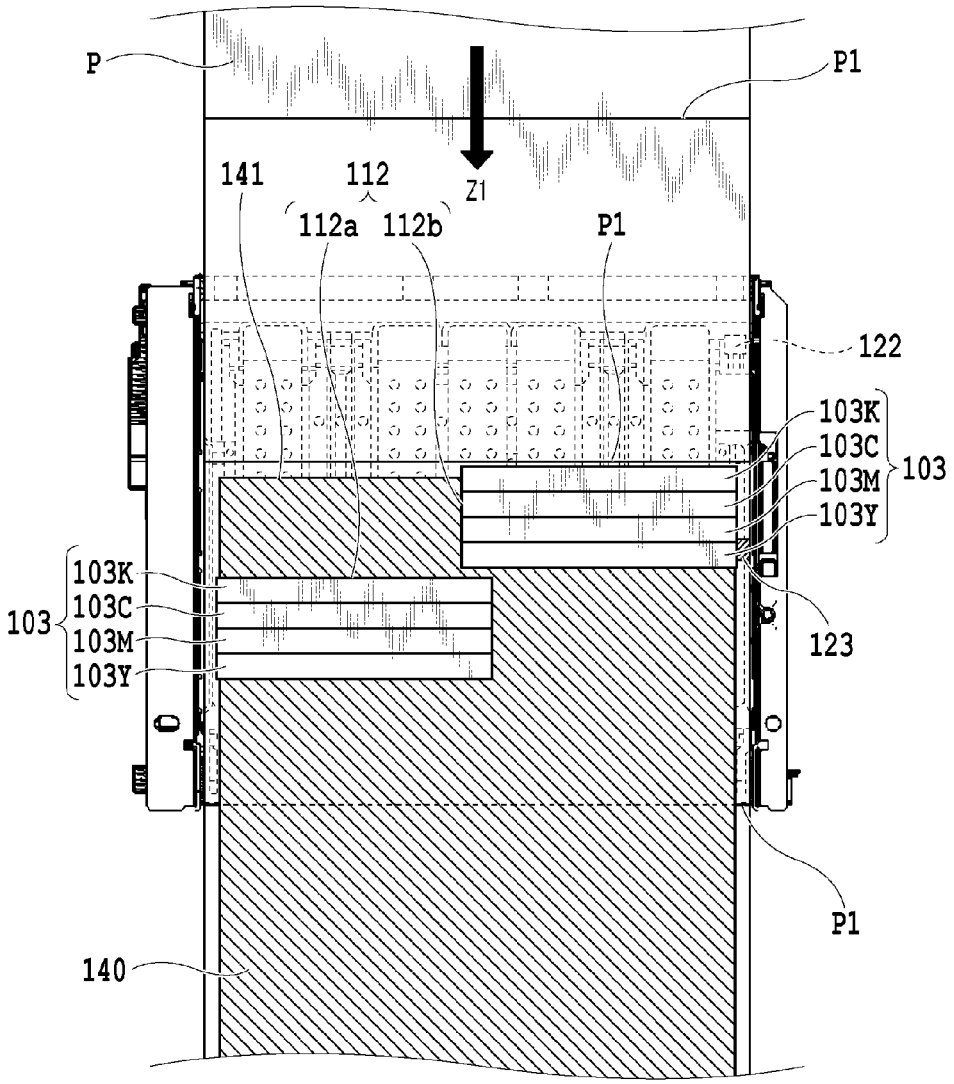
FIG. 9 is a view of assistance in explaining a condition where the printing operation is in the process of being resumed in the printing apparatus of FIG. 1.

FIG. 9 is a view of assistance in explaining a condition where the printing heads 103 are moved to the printing position while the paper P is conveyed again in the direction of conveyance indicated by arrow Z1. In this way the paper P is conveyed in the direction of conveyance indicated by arrow Z1, and when the time at which the printing heads 103 print an image to be connected to the image connection portion 141 is reached, the printing heads 103 start ink ejecting operation. At this time, when cockling occurs in a portion of the paper P on which an image has already been printed before the suspension of the printing operation, the portion (i.e. a cockling portion) 140 is to move past a position facing the printing heads 103 in the direction of conveyance. In this case, when the facing distance between the printing heads 103 and the conveyor belt 118 as the supporting unit is of the same size as that under normal printing operation conditions, the cockling portion 140 of the paper P may come in contact with the printing heads 103.

In this embodiment, therefore, the position of the printing heads 103 is changed so that the facing distance between the printing heads 103 and the conveyor belt 118 is greater than that under normal printing operation conditions until the cockling portion 140 moves past the position facing the printing heads 103. Then, after the cockling portion 140 has moved past the position facing the printing heads 103, the printing heads 103 are moved to a normal printing position so that the facing distance between the printing heads 103 and the conveyor belt 118 becomes equal to that under normal printing operation conditions. In this case, the two printing head modules 112 (112*a*, 112*b*) are staggered in such a manner that they are displaced in relation to each other in the direction of conveyance. The cockling portion 140 first moves past the position facing the printing heads 103 of the printing head module 112*b*, and therefore, the printing heads 103 of the printing head module 112*b* move to the normal printing position after waiting for the cockling portion 140 to move past the facing position. The cockling portion 140 then moves past the position facing the printing heads 103 of the printing head module 112*a*, and therefore, the printing heads 103 of the printing head module 112*a* move to the normal printing position after waiting for the cockling portion 140 to move past the facing position.

Figure 10:
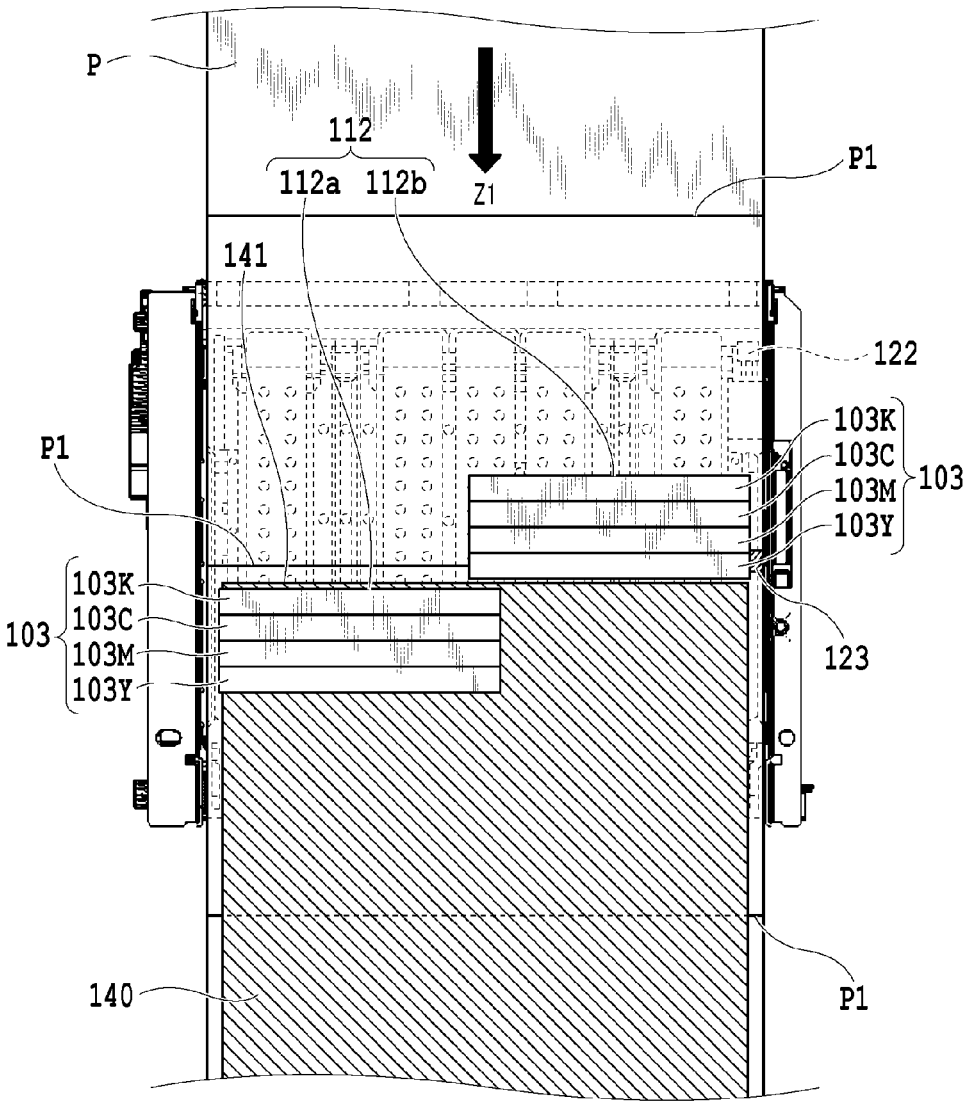
FIG. 10 is a view of assistance in explaining resumption of the printing operation of one printing head module of the printing apparatus of FIG. 1.

FIG. 10 is a view of assistance in explaining a condition where the printing heads 103 (103K, 103C, 103M, 103Y) of the printing head module 112*b* are moved to the normal printing position.

The printing heads 103K, 103C, 103M, 103Y of the printing head module 112*b* are located in such a way as to be displaced in the direction of conveyance indicated by arrow Z1, and therefore, the printing heads are different in the start time of printing of an image to be connected to the image connection portion 141. Specifically, the printing start time of the printing head 103K is earliest, and then, the printing start time of the printing heads 103C, 103M, 103Y becomes later in this order.

In this case, the printing head module 112*b* including the printing heads 103K, 103C, 103M, 103Y is moved up and down by the printing head raise/lower unit 130, and thus, the printing heads move to the normal printing position at the same time. In this case, therefore, the time at which the printing heads of the printing head module 112*b* move to the normal printing position is set to the time after the cockling portion 140 has moved past the position facing the printing head 103Y located closest to the paper discharge side, as illustrated in FIG. 10. Thus, the other three printing heads 103K, 103C, 103M temporarily eject the ink, while being in a state in which the facing distance between the printing heads 103 and the conveyor belt 118 is greater than that under normal printing operation conditions. However, the printing heads 103K, 103C, 103M move to the normal printing position after the cockling portion 140 has completely moved past the position facing these printing heads, and thus, the printing heads reliably avoid contact with the cockling portion 140. In addition, the printing heads 103K, 103C, 103M, 103Y may be individually moved up and down for individual setting of the time at which the printing heads are moved to the normal printing position. For example, the time of movement of the printing heads may be set so that the time of movement of the printing head 103K is earliest and then the time of movement of the printing heads 103C, 103M, 103Y becomes later in this order, in accordance with the printing start time.

Figure 11:
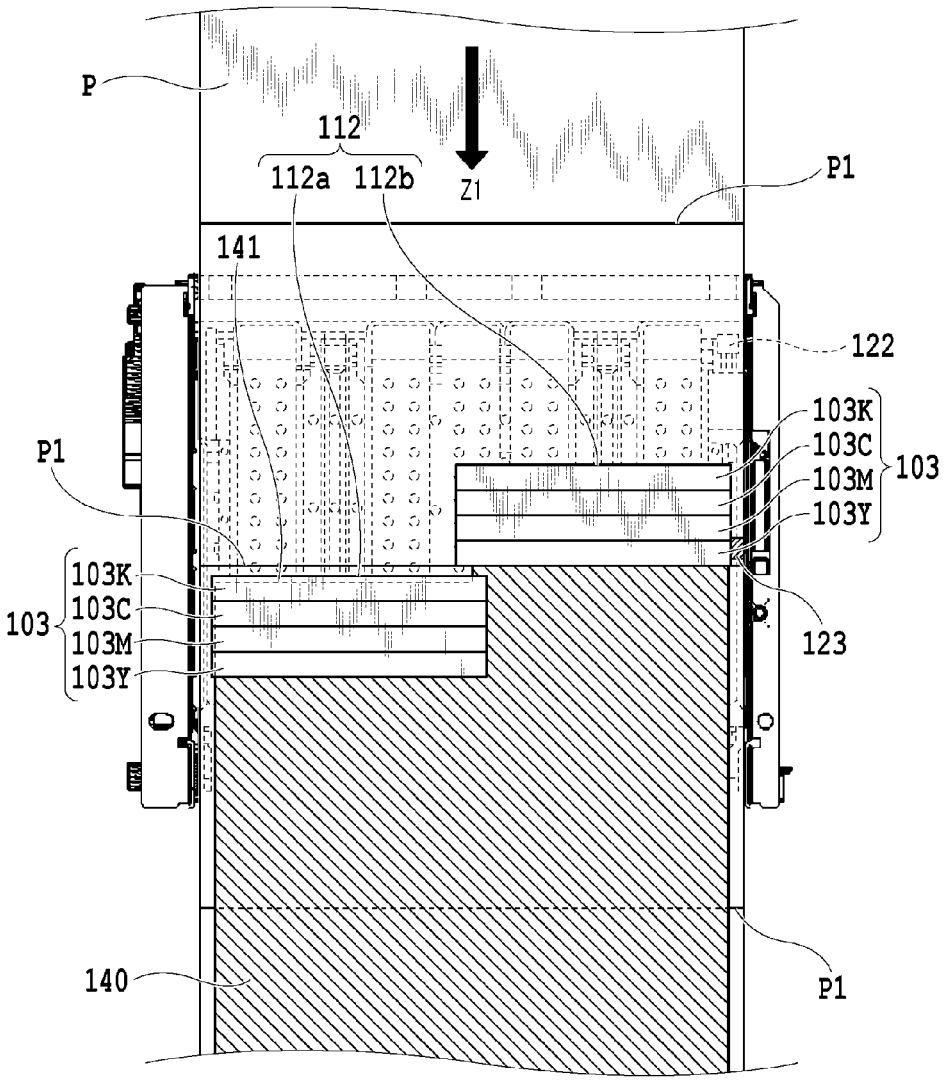
FIG. 11 is a view of assistance in explaining resumption of the printing operation of the other printing head module of the printing apparatus of FIG. 1.

FIG. 11 is a view of assistance in explaining a condition where the printing heads 103 (103K, 103C, 103M, 103Y) of the printing head module 112*a* are moved to the normal printing position. The time at which the printing heads of the printing head module 112*a* move to the normal printing position is set as in the case of the printing heads of the printing head module 112*b*. Specifically, the time is set to a time after the cockling portion 140 has moved past the position facing the printing head 103Y located closest to the paper discharge side, as illustrated in FIG. 11. In addition, the printing heads 103K, 103C, 103M, 103Y may be individually moved up and down for individual setting of the time at which the printing heads are moved to the normal printing position. For example, the time of movement of the printing heads may be set so that the time of movement of the printing head 103K is earliest and then the time of movement of the printing heads 103C, 103M, 103Y becomes later in this order, in accordance with the printing start time.

As described above, the contact of the cockling portion 140 with the printing heads 103 which may occur at the time of resumption of image printing operation can be prevented by setting the facing distance between the printing heads 103 and the conveyor belt 118 greater than that under normal printing operation conditions. The extent to which the facing distance between the printing heads 103 and the conveyor belt 118 is set greater than that under normal printing operation conditions (or the amount of increase in the facing distance) can be set according to the elapsed time since the suspension of the image printing operation, and the amount of ink ejected (or the amount of ink applied) for an image which has been printed before the suspension of the printing operation.

Figure 12:
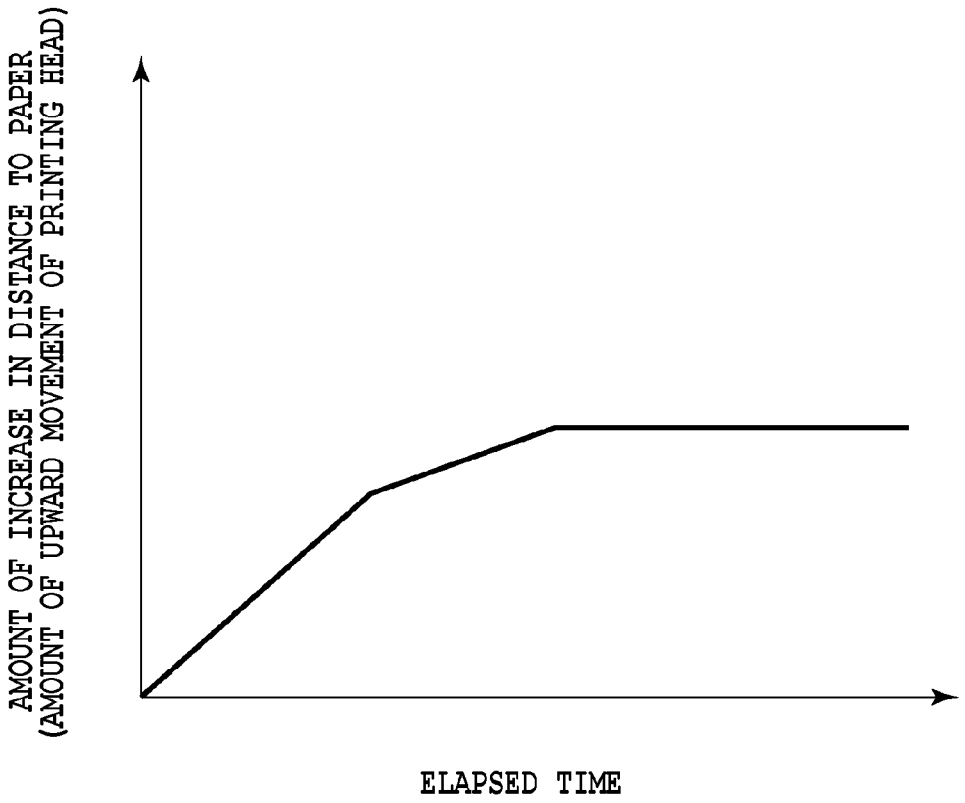
FIG. 12 is a graph of assistance in explaining a relationship between an elapsed time since the suspension of the printing operation and a distance to paper.

FIG. 12 is a graph of assistance in explaining a relationship between the elapsed time and the amount of increase in the facing distance between the printing heads 103 and the conveyor belt 118. The elapsed time is a time between the suspension of image printing operation and the resumption of the image printing operation. The amount of increase in the facing distance between the printing heads 103 and the conveyor belt 118 is the amount of increase in the facing distance relative to that under normal printing operation conditions, and corresponds to the amount of upward movement of the printing heads 103 moving up in a direction away from the paper P with respect to the normal printing position. A longer elapsed time leads to a higher position of the cockling portion 140 and hence requires a correspondingly larger amount of increase in the facing distance between the printing heads 103 and the conveyor belt 118. In addition, a somewhat short elapsed time eliminates a need to increase the facing distance because of causing no occurrence of cockling.

Figure 13:
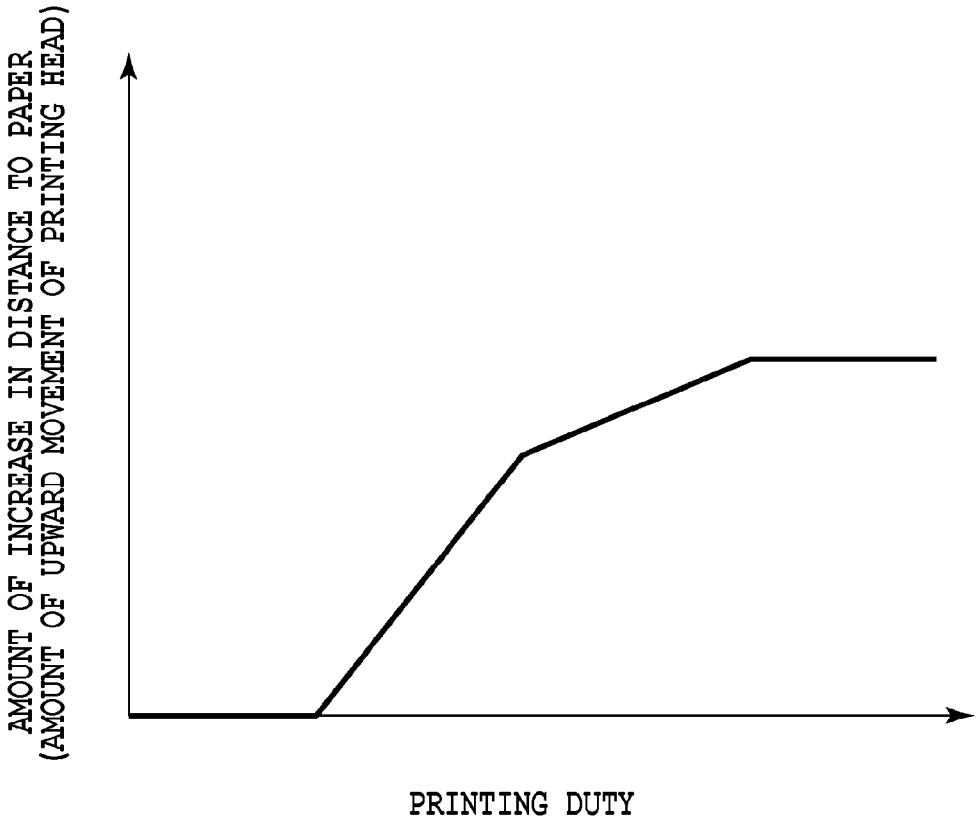
FIG. 13 is a graph of assistance in explaining a relationship between printing duty and a head-medium distance.

FIG. 13 is a graph of assistance in explaining a relationship between printing duty and the amount of increase in the facing distance between the printing heads 103 and the conveyor belt 118. The printing duty is information corresponding to the amount of ink ejected (or the amount of ink applied) on the paper P per unit area, and higher printing duty, or equivalently, a larger amount of ink ejected, leads to a higher position of the cockling portion 140. It is therefore necessary to increase the amount of increase in the facing distance between the printing heads 103 and the conveyor belt 118 according to the printing duty. In addition, somewhat low printing duty eliminates a need to increase the facing distance because of causing no occurrence of cockling.

Figure 14:
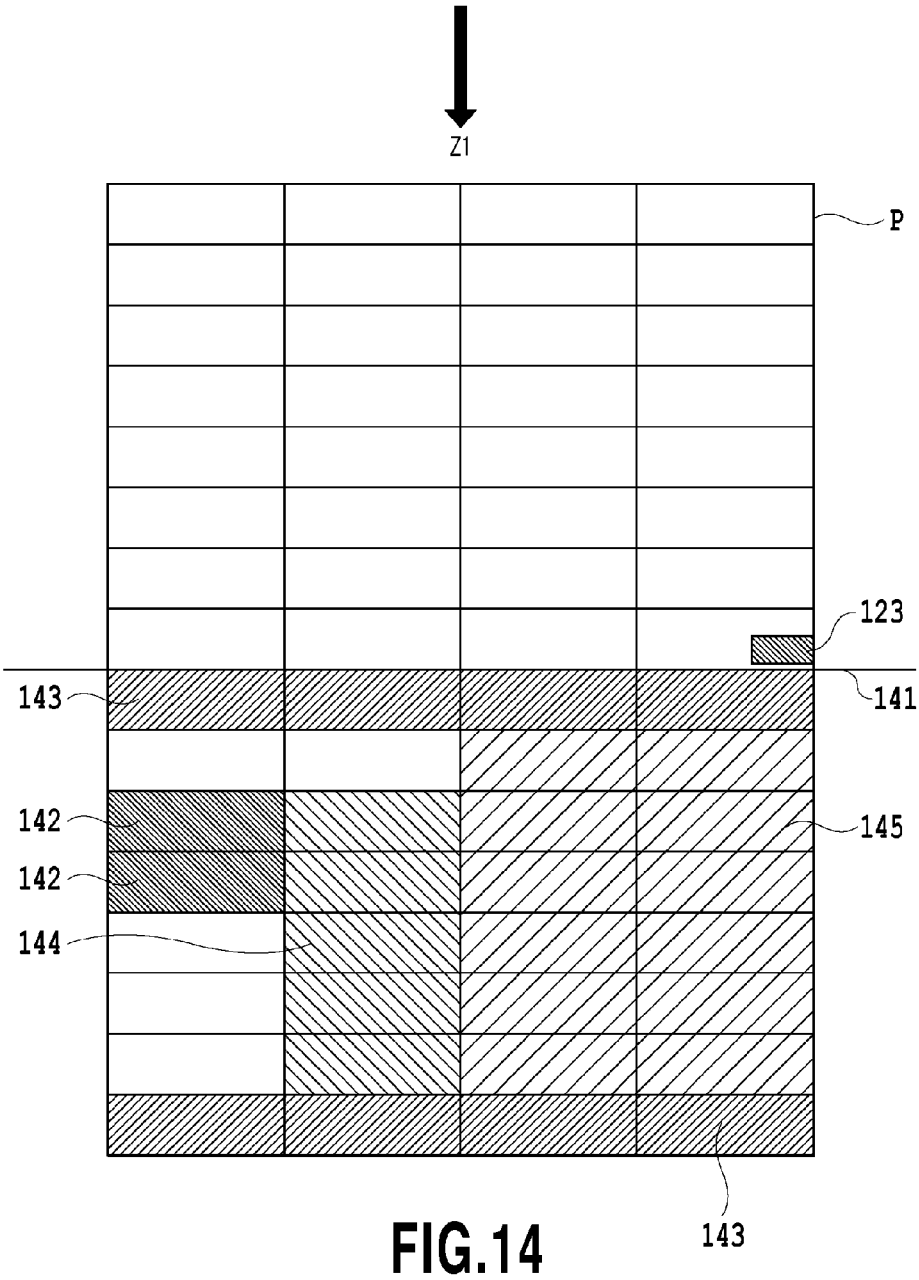
FIG. 14 is a diagram of assistance in explaining a method for determining the printing duty in the first embodiment of the present invention.

FIG. 14 is a diagram of assistance in explaining a method for determining the printing duty of a printed image (or a method for determining the amount of ink ejected).

The printing duty is determined for example by a page of image which has been printed before the image connection portion 141. Specifically, the page of image is divided into plural blocks, the printing duty is determined in block units, and the highest printing duty is judged as an effective printing duty (or an effective amount of ink ejected) in the page of image. Then, the amount of increase in the facing distance between the printing heads 103 and the conveyor belt 118 is determined according to the effective printing duty. More specifically, as illustrated in FIG. 14, a page of image is divided into 32 blocks, and the printing duty (or the amount of ink ejected) is determined in block units. In each of the blocks, the ink printing duty for each ink color is the ratio (%) of the actual amount of ink ejected to the largest amount of ink ejected (or a printing duty of 100%). In this case, four colors of ink are used for image printing, and therefore, the ink printing duty is the ratio (%) of the total amount of four colors of ink ejected to the largest amount of ink ejected (or a printing duty of 400%) for each block. In the case of FIG. 14, there are two blocks 142 having the highest printing duty, and there are blocks 143, 144, 145 having the second, third and fourth highest printing duty, respectively. In this case, the blocks 142 having the highest printing duty reflect the printing duty for the page of image. The reason is that cockling occurs locally in portions of blocks of high printing density having high printing duty and hence the largest amount of ink ejected. In the case of FIG. 14, therefore, priority is given to the blocks 142 having the highest printing duty, and the printing duty of the blocks 142 is judged as the printing duty for the page of image.

FIG. 15 is a table for explaining a control table in which the amount of increase in the facing distance between the printing heads 103 and the conveyor belt 118 is set based on the elapsed time and the printing duty described above, and in the control table, the printing duty (%) is associated with the amount of increase in the facing distance according to the elapsed time (s). If the printing duty is 0% to 60%, it is not necessary to increase the facing distance. If the printing duty is 60% to 80%, it is necessary to increase the facing distance when the elapsed time is equal to or longer than 20 seconds, while it is not necessary to increase the facing distance when the elapsed time is shorter than 20 seconds. Higher printing duty and also a longer elapsed time require a larger amount of increase in the facing distance. The contact of the paper P with the printing heads 103 can be prevented by setting the facing distance by using such a control table.

Figure 16:
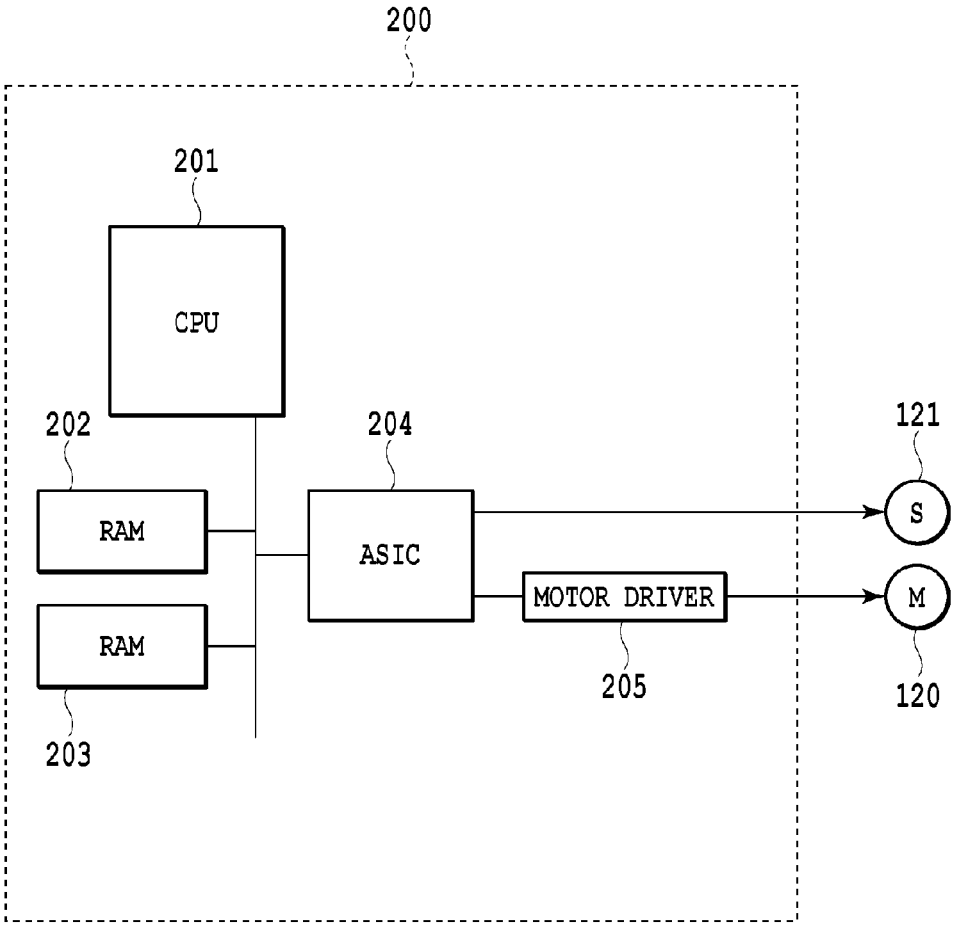
FIG. 16 is a block diagram of assistance in explaining a portion of a control system of the printing apparatus of FIG. 1.

FIG. 16 is a block diagram of a control system of a conveyor mechanism in the printing apparatus 101.

A board 200 includes a CPU (central processing unit) 201, a nonvolatile memory 203, and RAM (random access memory) 202, and has a built-in controller for the conveyor motor 120. The CPU 201 controls the units of the printing apparatus according to a program corresponding to a procedure for a conveying process for the paper P. The RAM 202 stores such a program and required fixed data. The RAM 202 is a working memory to temporarily store data and parameters and the like for use in the process of control performed by the CPU 201 and communications between the units of the printing apparatus, and the RAM 202 may be configured as SRAM (static RAM), for example. The nonvolatile memory 203 serves to retain required data even when the printing apparatus is in a power-off state, and the nonvolatile memory 203 may be configured as DRAM (dynamic RAM), for example. An ASIC (application specific integrated circuit) 204 as a control circuit for the conveyor motor 120 transmits a signal for controlling the conveyor motor 120 to a motor driver 205, and the motor driver 205 causes the conveyor motor 120 to operate based on the control signal. The CPU 201 controls the conveyor motor 120 based on a signal from the encoder 121. Specifically, the signal from the encoder 121 is counted by using the ASIC 204 and the conveyor motor 120 is controlled based on the count, and thereby, the paper P is conveyed at a set rate of conveyance.

In addition, the CPU 201 adjusts the position of movement (or the position of up and down movement) of the printing heads based on the printing duty and the elapsed time as previously mentioned, in order to increase the facing distance at the time of resumption of printing operation which has been suspended. Specifically, the printing head raise/lower units 130 are controlled based on a control table as illustrated in FIG. 15.

Figure 17:
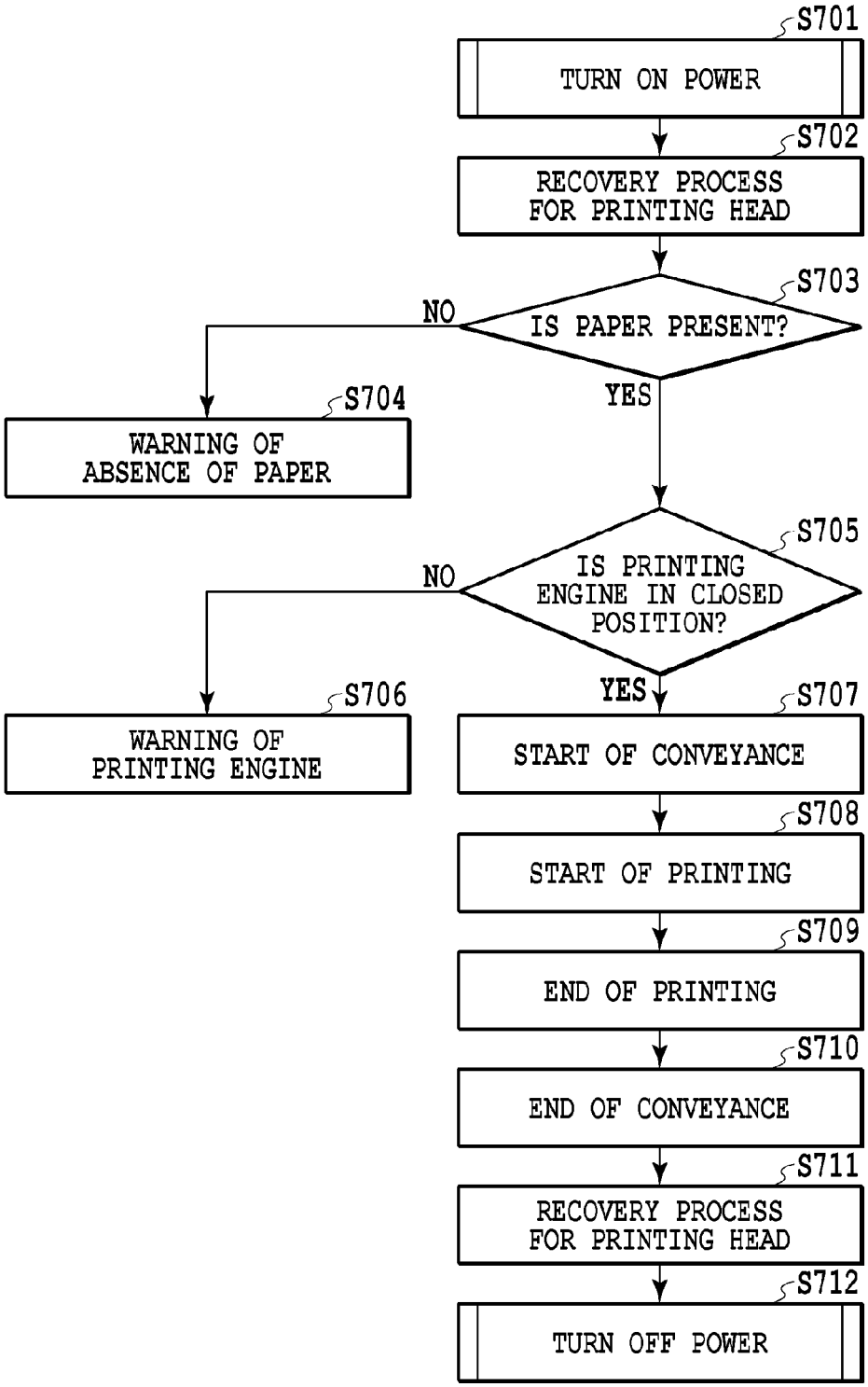
FIG. 17 is a flowchart of assistance in explaining the printing operation in the first embodiment of the present invention.

FIG. 17 is a flowchart of assistance in explaining a series of printing operations in the printing apparatus 101, and the flowchart is executed by the CPU 201.

The printing apparatus 101 is powered on (S701), and then the CPU 201 executes a recovery process for maintaining the printing heads 103 in good condition of ink ejection (S702). The recovery processes may include operation for ejecting (or pre-ejecting) or sucking out ink which does not contribute to image printing, through the ejection ports of the printing heads, and wiping operation for wiping surfaces of the printing heads in which the ejection ports are formed. After that, the CPU 201 detects the presence or absence of the paper P in the printing apparatus 101 (S703). When the paper P is absent, the CPU 201 issues a warning to notify the user of "the absence of the paper" (S704). When the paper P is present, the CPU 201 determines whether or not the printing engine 105 is in a closed position (S705). When the printing engine 105 is open, the CPU 201 issues a warning to notify the user that "the printing engine is open" (S706). When the printing engine 105 is in the closed position, the CPU 201 starts the conveyance of the paper P (S707), and the printing heads 103 start image printing operation by ejecting the ink based on pint data transmitted from the PC 102 (S708). After the completion of the image printing based on the print data transmitted from the PC 102, the CPU 201 brings the printing operation to an end (S709) and brings the conveyance of the paper P to an end (S710). After that, the CPU 201 executes the recovery process for the printing heads 103 (S711) and then powers off the printing apparatus 101 (S712).

Incidentally, in the inkjet printing apparatus of the first embodiment, the CPU 201 as control unit adjusts the position of movement (or the position of up and down movement) of the printing head based on the printing duty and the elapsed time; however, the present invention is not so limited. For example, the control unit may adjust the position of movement of the printing head based on the elapsed time, without consideration for the printing duty, or may adjust the position of movement of the printing head based on the printing duty, without consideration for the elapsed time.

The inkjet printing apparatus of the first embodiment is the full line type printing apparatus in which the printing head 103 in a fixed position ejects the ink onto the printing medium conveyed by the conveyor belt 118, or equivalently, the printing apparatus in which the printing medium is moved relative to the printing head. However, the present invention is not so limited but may be applied to printing apparatuses of other types. For example, the present invention may be applied to the serial scan type printing apparatus in which the printing head moves relative to the printing medium. In the serial scan type printing apparatus, at the time of resumption of printing operation which has been suspended, a printed image on the printing medium moves past the printing position facing the printing head (in the serial scan type, the printing position also moves by movement of the printing head). For example, when the printed image moves past the printing position facing the printing head as described above, the CPU 201 as the control unit may set the facing distance between the printing head and the supporting unit supporting the printing medium greater than that under normal printing conditions. Alternatively, in the serial scan type printing apparatus, the control unit may adjust the position of movement of the printing head based on the elapsed time, without consideration for the printing duty, or may adjust the position of movement of the printing head based on the printing duty, without consideration for the elapsed time. Moreover, the control unit may adjust the position of movement of the printing head based on the printing duty and the elapsed time. As described above, the present invention may be applied to both the full line type and the serial scan type in which the printing position facing the printing head and the printing medium move relative to each other.

Second Embodiment

In a second embodiment, the amount of increase in the facing distance is individually adjusted for each of the printing head modules 112*a*, 112*b*. Therefore, effective printing duty for a printing region A1 corresponding to the printing head module 112*a* and effective printing duty for a printing region A2 corresponding to the printing head module 112*b* are individually determined. The optimum amount of increase in the facing distance can be individually set for each of the printing head modules 112*a*, 112*b*, based on the effective printing duty.

Figure 18:
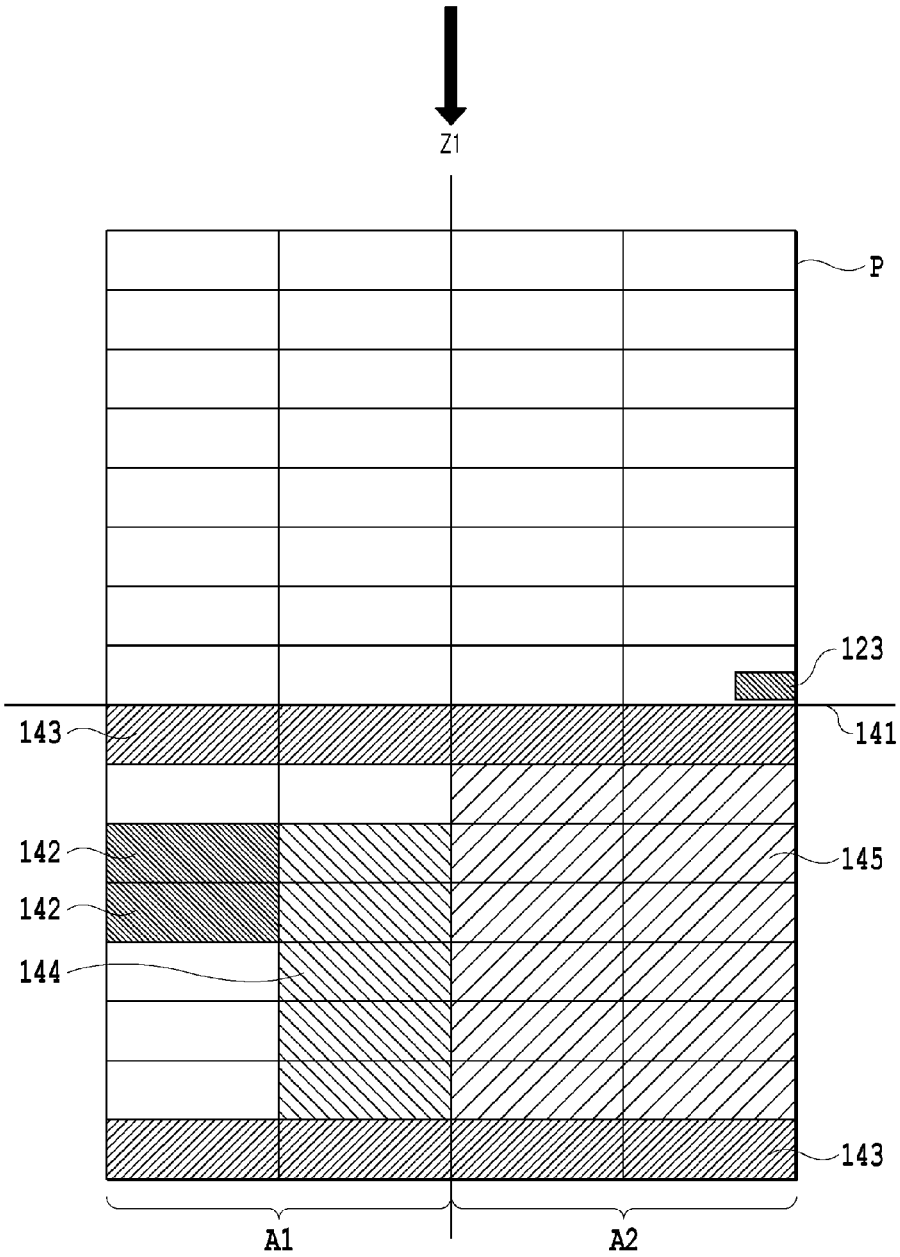
FIG. 18 is a diagram of assistance in explaining a method for determining the printing duty in a second embodiment of the present invention.

In the case of FIG. 18, the blocks 142 having the highest printing duty are present in the printing region A1, not in the printing region A2. In the printing region A2, the blocks having the highest printing duty are the blocks 143 having the second highest printing duty. Therefore, the printing duty of the blocks 142 is judged as the effective printing duty for the printing region A1 corresponding to the printing head module 112*a*, and the amount of increase in the facing distance for the printing head module 112*a* is set based on the effective printing duty. Meanwhile, the printing duty of the blocks 143 is judged as the effective printing duty for the printing region A2 corresponding to the printing head module 112*b*, and the amount of increase in the facing distance for the printing head module 112*b* is set based on the effective printing duty. In the case of the second embodiment, the amount of increase in the facing distance for the printing head module 112*b* can be set smaller than the amount of increase in the facing distance for the printing head module 112*a*. Adjustment of the facing distance in the second embodiment as described above may be applied to the serial scan type printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-038499, filed Feb. 24, 2012 and 2012-256489, filed Nov. 22, 2012, which are hereby incorporated by reference herein in their entirety.

What is claimed is:

1. An inkjet printing apparatus for printing an image on a printing medium by a printing operation in which a printing head module ejects ink onto the printing medium during relative movement between the printing head module and the printing medium in a first direction, the printing head module having a plurality of nozzle arrays in each of which a plurality of nozzles capable of ejecting ink are arranged in a second direction crossing the first direction, the plurality of nozzle arrays being deviated from each other in the first direction, the apparatus being capable of resuming the printing operation after suspension of the printing operation, the apparatus comprising:

a supporting unit configured to support the printing medium on which the image is printed by the printing head module;

an adjusting unit capable of adjusting a facing distance between the printing head module and the supporting unit; and a control unit configured to control the adjusting unit so that a facing distance between the printing head module and the supporting unit is greater than that during the printing operation in a case that the printing operation is suspended and the image printed on the printing medium moves to a plurality of printing positions corresponding to each of the plurality of nozzle arrays, and so that the facing distance decreases in accordance with a timing in which the image printed on the printing medium has passed through all of the plurality of printing positions in the first direction.

2. An inkjet printing method for printing an image on a printing medium by a printing operation in which a printing head module ejects ink onto the printing medium during relative movement between the printing head module and the printing medium in a first direction, the printing head module having a plurality of nozzle arrays in each of which a plurality of nozzles capable of ejecting ink are arranged in a second direction crossing the first direction, the plurality of nozzle arrays being deviated from each other in the first direction, in which the printing operation is resumed after suspension of the printing operation, the method comprising the steps of:

in a case that the printing operation is suspended and the image printed on the printing medium moves to a plurality of printing positions corresponding to each of the plurality of nozzle arrays, setting a facing distance between the printing head module and a supporting unit supporting the printing medium on which the image is printed by the printing head module to be greater than that during the printing operation, and setting the facing distance to decrease in accordance with a timing in which the image printed on the printing medium has passed through all of the plurality of printing positions in the first direction.

3. The inkjet printing apparatus according to claim 1, wherein a plurality of printing head modules are provided, a plurality of adjusting units are provided so as to individually adjust the facing distance corresponding to each of the plurality of printing head modules, and the control unit individually controls the plurality of adjusting units.

4. The inkjet printing apparatus according to claim 1, wherein the control unit controls the adjusting unit based on a time elapsed from the suspension of the printing operation, so that a facing distance between the printing head module and the supporting unit is greater as the elapsed time is longer.

5. The inkjet printing apparatus according to claim 4, wherein the control unit controls the adjusting unit by using a table which associates, with one another, the time elapsed from the suspension of the printing operation, the facing distance, and information corresponding to an amount of ink that has been applied onto the printing medium for printing the image to be moved to the printing positions after the printing operation is suspended.

6. The inkjet printing apparatus according to claim 1, wherein in a case where an end portion of the image printed on the printing medium moves to the printing positions in the first direction after the printing operation is suspended, the control unit controls the printing operation so that an image to be printed at a time of the resumption of the printing operation is connected to the end portion of the image.

7. The inkjet printing apparatus according to claim 6, further comprising a convey unit configured to convey the printing medium in a direction in which the image printed on the printing medium moves to the printing positions.

8. An inkjet printing apparatus for printing an image on a printing medium by a printing operation in which a printing head module ejects ink onto the printing medium during relative movement between the printing head module and the printing medium in a first direction, the printing head module having a plurality of nozzle arrays in each of which a plurality of nozzles capable of ejecting ink are arranged in a second direction crossing the first direction, the plurality of nozzle arrays being deviated from each other in the first direction, the apparatus comprising:

a supporting unit configured to support the printing medium on which the image is printed by the printing head module;

an adjusting unit capable of adjusting a facing distance between the printing head module and the supporting unit; and a control unit configured to control the adjusting unit so that a facing distance between the printing head module and the supporting unit is greater than that during the printing operation in a case that the image printed on the printing medium moves to a plurality of printing positions corresponding to each of the plurality of nozzle arrays, and so that the facing distance decreases in accordance with a timing in which the image printed on the printing medium has passed through all of the plurality of printing positions in the first direction.

* * * * *